United States Patent [19]

Meadows

[11] Patent Number: 4,466,206

[45] Date of Patent: Aug. 21, 1984

[54] PICTURE FRAME

[76] Inventor: Roy N. Meadows, 900 Hearthside, South Lyon, Mich. 48178

[21] Appl. No.: 415,815

[22] Filed: Sep. 8, 1982

[51] Int. Cl.[3] ..... G09F 1/12

[52] U.S. Cl. ..... 40/152.1; 40/156; 248/489

[58] Field of Search ..... 40/152.1, 156, 152, 40/10 R

[56] References Cited

U.S. PATENT DOCUMENTS

| | | | |
|---|---|---|---|
| 1,342,477 | 6/1920 | Walas | 40/156 |
| 2,709,056 | 5/1955 | Jacquet | 40/152.1 |
| 3,596,392 | 8/1971 | Vani | 40/156 |
| 3,665,629 | 5/1972 | Shore | 40/156 |
| 3,680,239 | 8/1972 | Andrews | 40/152.1 |

*Primary Examiner*—Gene Mancene

*Assistant Examiner*—Wenceslao J. Contreras

*Attorney, Agent, or Firm*—Hauke & Patalidis

[57] ABSTRACT

A picture frame for displaying graphics such as paintings, photographs, documents, diplomas and the like. The picture frame comprises a plurality of marginal frame members, a window affixed within the frame members, a hinged closure back panel with compression pads for pressing a graphic against the window and a pivotable latch member for holding the closure back panel in a set position. The latch member, formed in the shape of an arrowhead, also serves as means for mounting the picture frame to a hook or nail by a recess formed in one surface of the latch member. The recess is provided with converging sidewalls which guide the nail or hook to a top portion of the recess provided with increased depth.

5 Claims, 4 Drawing Figures

FIG. 1
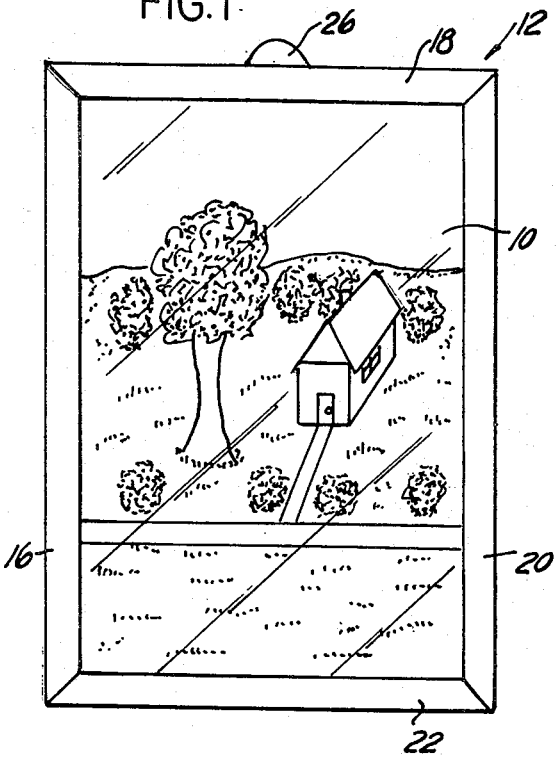
FIG. 2
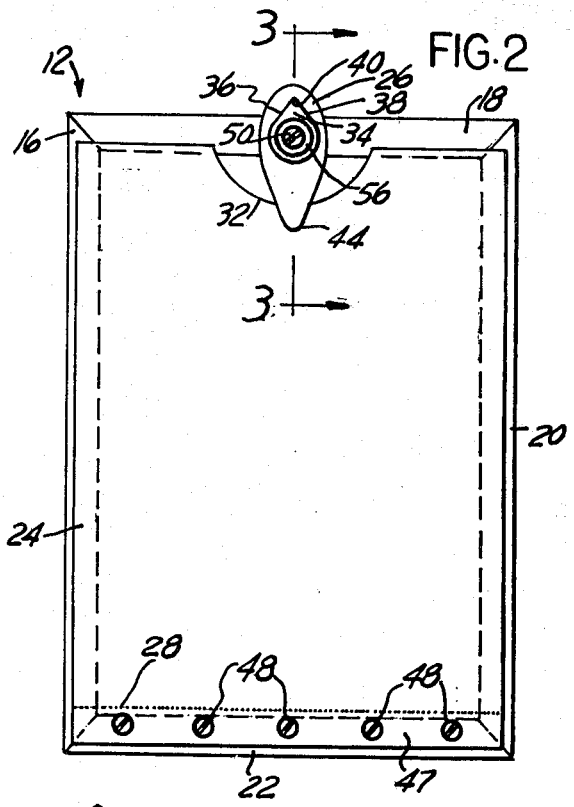
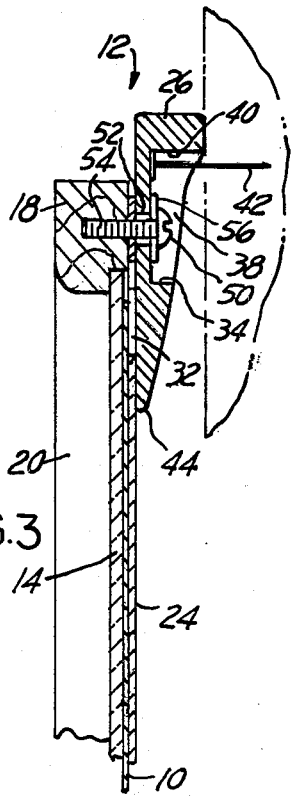
FIG. 3
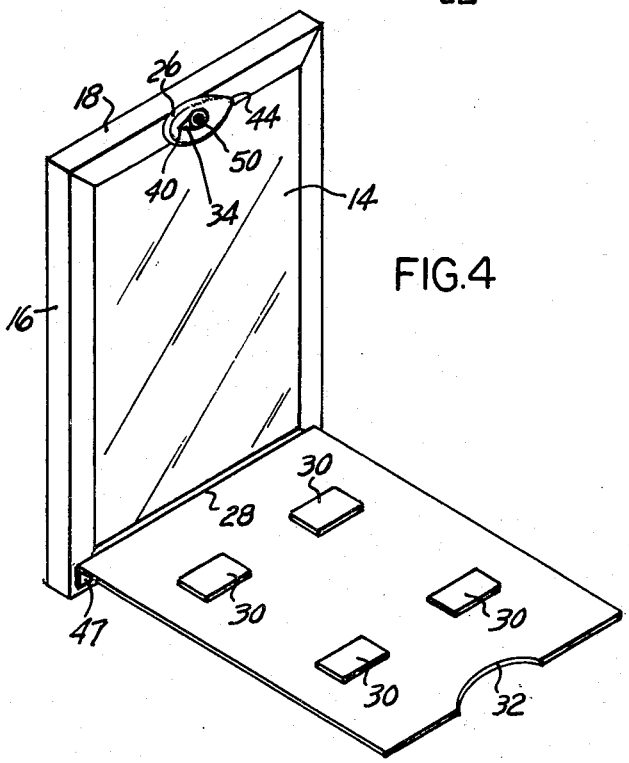
FIG. 4

PICTURE FRAME

BACKGROUND OF THE INVENTION

The present invention relates to assemblies for displaying graphics such as paintings, photographs, documents, diplomas and the like. More particularly, the invention relates to those assemblies which are removably mounted on a wall and are commonly referred to as "picture frames".

Although several varieties of picture frames are presently available, each type has substantial inconveniences. One common problem area resides in the means for mounting the picture frame to a wall.

A picture frame is generally mounted on a wall by suspending the picture frame from a member protruding from the wall, for example, from a nail or a hook. For this purpose a length of string or wire may be fastened at opposite sides of the picture frame such that the wire or string extends along the back of the picture frame. With this arrangement, the picture frame is suspended from the nail or hook by placing the wire or string over the nail or hook. In order to have the picture frame mounted in a level fashion, it is necessary for a person to slide the picture frame back and forth along the wire or string until the center of gravity of the picture frame is ascertained. Of course, a picture frame so mounted is easily knocked off center by a careless person and may come to rest on the floor after being dislodged, causing aggravation to a picture frame owner and damage to the picture frame itself.

Another common means for suspending a picture frame from a nail or a hook is to affix a bracket provided with a hole to the back of the picture. In use, the nail or hook is passed through the bracket hole, thus suspending the picture from slightly outwardly from the wall. Unlike the string or wire arrangement type of picture frame mount, the perforate bracket arrangement provides for suspending a picture frame in an easily retained fixed position. However, the initial mounting of a picture frame in this manner is generally quite difficult. This is because the aligning of the hole in the bracket with the hook or nail, prior to mounting the picture frame by sliding the hole over the hook or nail, can only be accomplished by a person placing his or her head against the wall so as to see behind the frame, simultaneously holding the frame, and gradually moving the frame provided with the mounting bracket toward the hook or nail in the wall. In actuality, therefore, with a picture frame of any substantial size it is preferable that the hanging of a picture frame provided with a mounting bracket be performed by two persons.

Another shortcoming of picture frames of the prior art is the means provided for enclosing a graphic within a picture frame. Typically, a removable closure back panel, being somewhat smaller in over-all perimeter than the frame itself, holds a graphic against a transparent front panel, such as a pane of glass, mounted within the frame. The graphic is retained and displayed in a fixed, desired position within the picture frame by the frictional inter-reaction between the surfaces of the graphic and the surfaces of the glass pane and the closure back panel. The closure back panel is retained in its graphic-holding position by a plurality of clasps provided around, and protruding from, the interior periphery of the frame back.

It is frequently the case that the graphic secured in the above-described manner eventually slips between the glass pane and closure back panel because of insufficient frictional inter-reaction between the surfaces in engagement. As a result, gravity may cause the graphic to slip downwardly from its preset position within the picture frame to an undesired position. Moreover, to fixedly insert a graphic within the picture frame entails the task of bending over each of the numerous bendable clasps retaining the closure back panel, which frequently break upon bending, or to install a plurality of clips.

What is needed, therefore, is an improved graphic display assembly, or picture frame, in which a graphic may be rapidly and securely installed and which may thereafter be easily mounted in a balanced and stable fashion to a wall.

SUMMARY OF THE INVENTION

The present invention remedies the inconveniences of the prior art by a novel graphic display device of the type generally referred to as a picture frame.

One object of the invention is to provide a picture frame with a pivotable latch for holding a hinged closure back panel in a fixed position. A recess in the latch also serves as the means for mounting the picture frame to a member protruding from a wall, such as a nail or hook.

In addition the closure back panel of the improved picture frame is provided with a plurality of compression pads affixed to the interior surface of the closure back panel for fixedly pressing a graphic to the transparent front panel when the picture frame is closed.

These and other objects and advantages of the present invention will become apparent to those skilled in the art when the following description of the best mode contemplated for practicing the invention is read in conjunction with the accompanying drawing wherein:

BRIEF DESCRIPTION OF THE DRAWING

FIG. 1 is a front elevational view of an example of picture frame according to the present invention in which a picture is displayed;

FIG. 2 is a rear elevational view thereof;

FIG. 3 is a cross-section of a portion thereof from line 3—3 of FIG. 2; and FIG. 4 is a rear perspective view of the picture frame shown with the back open and with the picture removed.

DETAILED DESCRIPTION OF THE PREFERRED EMBODIMENT

Referring now to the drawing, and more particularly to FIG. 1, a picture 10 is displayed from within a picture frame 12. More particularly, the picture 10 is seen from behind a substantially flat and transparent pane or window 14, such as a pane of glass or a sheet of plastic, mounted in the picture frame 12.

In the illustrated structure the picture frame 12 comprises four interconnected marginal frame members 16–22 respectively, joined to each other at their respective ends with bevel cuts, the transparent window panel 14 being affixed between the frame members 16–22. A hinged closure back panel 24 is hingedly attached at one end to the rear surface of the lower frame member 22 and a pivotable latch member 26 is attached to the rear surface of the upper frame member 18, proximate the center thereof.

The hinged closure back panel 24 and the pivotable latch member 26 co-operate to press the image-provided surface of the picture 10 against the transparent panel or window 14 when the picture frame 12 is closed. To open the picture frame 12 for insertion of the picture 10, the pivotable latch member 26, the structure of which is fully described hereafter, is rotated such that its longitudinal axis is substantially parallel to the longitudinal axis of the frame member 18 to which it is attached, FIG. 4. This frees the top portion of the hinged closure back panel 24 to be pivoted away from the inter-connected frame members 16, 18, 20 of the picture frame 12 about a creaseline 28. The creaseline 28 is formed in the closure back panel 24, for example proximate the inner edge of the lower frame member 22 and extends substantially parallel thereto. The portion 47 of the back panel 24 beyond the creaseline 28 is attached to the lower frame member 22 by a plurality of equally spaced-apart screws 48 passed through the back panel portion 47 into the frame member 22 and disposed in a row substantially parallel to the creaseline 28. Hinge arrangements other than the creaseline 28 may be provided, such as a length of piano hinge or the like. After the picture 10 is placed against the transparent panel or window 14, the closure back panel 24 is pivoted toward the picture frame 12 about the creaseline 28 until its remaining edges abut the frame members 16–20. The pivotable latch member 26 is thereafter rotated approximately 90° from the position shown at FIG. 4 to the position shown at FIG. 2 such that the latch member 26 holds the closure back panel 24 against the frame members 16–20 and against the picture.

To increase the frictional force applied by the closure back panel 24 against the back of the picture 10, and thereby to prevent slippage of the picture 10 from a predetermined position with respect to the transparent panel or window 14 when the picture frame 12 is closed and in use, the closure back panel 24 is preferably provided with a plurality of compression pads 30, FIG. 4, on the inner surface of the closure back panel 24 which abut frame members 16–20, when the picture frame 12 is closed, FIG. 2. As shown, the compression pads 30 are four in number, spaced-apart a substantially equal distance from each other and are rectangular in cross-section. Both the closure back panel 24 and the compression pads 30 may be made of cardboard, although the compression pads 30 are preferably made of elastomeric material.

The closure back panel 24 is preferably provided with a cut-out portion 32 along its top edge so as to clear any protruding portion of the pivotable latch member 26 when it is desired to open the picture frame 12.

An important feature of the pivotable latch member 26 is a recess 34 formed in one side of the latch member 26. The recess 34, as shown, is provided with upwardly-sloped, converging sidewalls 36 and 38 and has a relatively narrow portion of increased depth, indicated at 40, at the top. This recess configuration permits a hanging post 42 protruding from a wall, such as a nail or a hook, to be directed by the converging sidewalls 36 and 38 to the deepest and top portion 40 of the recess 34. Accordingly, the picture frame 12 can be securely hung on the protruding hanging post 42 with relative ease.

The body of the latch member 26 can be formed, for example, in the shape of an arrowhead provided with a converging pointed portion 44 of sufficient length to extend over the cut-out portion 32 of the closure back panel 24 when the picture frame is closed, FIG. 2. The latch member 26 is pivotably attached to the frame member 18, for example, by means of a screw 50 passed through a transverse bore 52 substantially at the center of the recess 34 and threading in a bore 54 in the center of the upper frame member 18. A washer 56 can be disposed under the head of the screw 50, if desired.

The frame members 16–22 and the latch member 26 can be formed on any suitable material, such as wood, plastic or stainless steel. As an example of structure, the whole picture frame 12, with the exception of the back panel 24, may be molded of a single piece of transparent plastic, with the frame members 16–22 painted over, and the latch member 26 may also be molded of plastic.

Having thus described the present invention by way of an example of structure well designed to accomplish the purpose of the invention, modifications whereof will be apparent to those skilled in the art, what is claimed as new is as follows:

1. A picture frame for displaying a graphic comprising a plurality of interconnected marginal frame members, a substantially flat, transparent window affixed between said marginal frame members, a substantially flat closure back panel holding said graphic against said transparent window when said closure back panel is in a closed position, a latch member attached to one of said frame members and having a protruding portion retaining said closure back panel in said closed position, and a recess in said latch member for mounting said picture frame directly on a hanging post protruding from an adjacent wall, wherein said latch member is pivotably attached to said one of said frame members and is rotatable from a first position whereby said protruding portion retains said closure back panel in said closed position to a second position whereby said protruding portion frees said closure back panel and wherein said recess in said latch member is provided with converging sidewalls which guide a projecting end of said hanging post protruding from said adjacent wall to a predetermined position within said recess.

2. The picture frame of claim 1 wherein said closure back panel is hingedly attached to a second of said frame members and is pivotably displaceable from said closure position holding said graphic against said transparent window to an open position permitting removal of said graphic from said frame.

3. The picture frame of claim 1 further comprising a plurality of compression pads affixed across a lateral surface of said closure back panel whereby said compression pads press against said graphic when said closure back panel is in said closed position.

4. The picture frame of claim 1 wherein said marginal frame members and said transparent window are formed of a single piece of molded plastic.

5. The picture frame of claim 1 wherein said predetermined position in said recess is a point of greatest depth of said recess.

* * * * *